US008197098B2

(12) United States Patent
Cook

(10) Patent No.: US 8,197,098 B2
(45) Date of Patent: Jun. 12, 2012

(54) THERMALLY MANAGED LED RECESSED LIGHTING APPARATUS

(75) Inventor: William V. Cook, Winter Haven, FL (US)

(73) Assignee: Wyndsor Lighting, LLC, Winter Haven, FL (US)

( * ) Notice: Subject to any disclaimer, the term of this patent is extended or adjusted under 35 U.S.C. 154(b) by 349 days.

(21) Appl. No.: 12/559,075

(22) Filed: Sep. 14, 2009

(65) Prior Publication Data

US 2011/0063831 A1 Mar. 17, 2011

(51) Int. Cl.
*F21V 29/00* (2006.01)

(52) U.S. Cl. ..... 362/294; 362/364; 362/373

(58) Field of Classification Search ..... 362/147, 362/249.02, 294, 311.02, 311.14, 311.15, 362/364, 365, 366, 373
See application file for complete search history.

(56) References Cited

U.S. PATENT DOCUMENTS

| | | | | |
|---|---|---|---|---|
| 6,213,622 | B1 | 4/2001 | Shimada et al. | |
| 6,250,774 | B1 | 6/2001 | Begemann et al. | |
| 6,416,200 | B1 | 7/2002 | George | |
| 6,517,221 | B1 | 2/2003 | Xie | |
| 6,784,357 | B1 | 8/2004 | Wang | |
| 6,910,794 | B2 | 6/2005 | Rice | |
| 6,942,361 | B1 | 9/2005 | Kishimura et al. | |
| 6,976,769 | B2 | 12/2005 | McCullough et al. | |
| 7,095,110 | B2 | 8/2006 | Arik et al. | |
| 7,210,832 | B2 | 5/2007 | Huang | |
| 7,314,291 | B2 | 1/2008 | Tain et al. | |
| 7,329,030 | B1 | 2/2008 | Wang | |
| 7,331,691 | B2 | 2/2008 | Livesay et al. | |
| 7,349,163 | B2 * | 3/2008 | Angelini et al. | 362/311.02 |
| 7,413,326 | B2 | 8/2008 | Tain et al. | |
| 7,438,440 | B2 | 10/2008 | Dorogi | |
| 7,438,449 | B2 | 10/2008 | Lai et al. | |
| 7,467,878 | B2 | 12/2008 | Li | |
| 7,488,093 | B1 | 2/2009 | Huang et al. | |
| 7,494,248 | B2 | 2/2009 | Li | |
| 7,505,268 | B2 | 3/2009 | Schick | |
| 7,540,636 | B2 | 6/2009 | Lai et al. | |
| 7,540,761 | B2 | 6/2009 | Weber et al. | |
| 7,547,124 | B2 | 6/2009 | Chang et al. | |
| 7,909,489 | B2 * | 3/2011 | Lin et al. | 362/249.02 |
| 2005/0117351 | A1 * | 6/2005 | Kuisma | 362/294 |
| 2008/0055908 | A1 * | 3/2008 | Wu et al. | 362/373 |
| 2009/0086491 | A1 | 4/2009 | Ruud et al. | |
| 2009/0147522 | A1 | 6/2009 | Shuai et al. | |
| 2009/0168416 | A1 | 7/2009 | Zhang et al. | |
| 2010/0308731 | A1 * | 12/2010 | Mo | 362/294 |

* cited by examiner

*Primary Examiner* — Y My Quach Lee
(74) *Attorney, Agent, or Firm* — GrayRobinson, P.A.

(57) ABSTRACT

An LED recessed lighting apparatus has a housing mountable in a recess located behind a recess opening in an architectural structure. A non-vented trim is securable in place over the recess opening. A lens that allows light from the LED to pass through the trim has a fluid-tight internal cavity containing at least the light-emitting portion of the LED. At least a major portion of the heat generated by the LED is carried directly from the LED to the outside surface of said trim by way of a thermal path that includes a first heat sink located substantially immediately adjacent and intimately thermally conductively coupled to the LED, at least one second heatsink supported by and substantially directly thermally conductively coupled to, the inside of the trim, and at least one heat pipe thermally connecting the first heat sink to the second heat sink.

26 Claims, 4 Drawing Sheets

THERMALLY MANAGED LED RECESSED LIGHTING APPARATUS

CROSS-REFERENCE TO RELATED APPLICATIONS

Not Applicable.

STATEMENT REGARDING FEDERALLY SPONSORED-RESEARCH OR DEVELOPMENT

Not Applicable.

INCORPORATION BY REFERENCE

Not Applicable.

FIELD OF THE INVENTION

The invention relates to the field of recessed lighting fixtures, luminaires, and lighting modules for general illumination or architectural illumination of indoor or outdoor areas using light emitting diodes (LED's). More particularly, the invention relates to a thermally managed recessed LED lighting apparatus having a trim and a fluid-tight LED module which are thermally coupled to one another by way of a thermal management pathway through which at least a major portion of the steady state thermal burden generated by the LED illumination source can be off-loaded from the trim to the exterior ambient environment without need of providing ventilation through or behind the trim to avoid causing a fire hazard and/or shortening the operating life expectancy of the LED due to excessive temperature. Since the apparatus does not rely on convection for the uptake of heat from the LED, at least the light emitting portion of the LED can be located within a fluid-tight cavity of a lens, thus making the apparatus suitable for wet or even underwater locations.

In order to successfully manage the thermal burden under both start-up and steady state operating conditions, a preferred embodiment of the invention includes a first heat sink mounted substantially immediately adjacent to, and in intimate thermally conductive proximity to the LED, a second heat mounted and thermally conductive proximity to the inside surface of the trim, and at least one heat pipe mechanically and intimately thermally conductively coupled between the first and second heatsinks. Owing to its thermal capacity and close physical and thermal proximity to the LED, the first heat sink absorbs enough heat from the LED sufficiently quickly by thermal conduction to prevent overheating of the LED at startup. Before the first heat sink can become too warm to protect the LED, heat flow downstream though the heat pipe rapidly conducts heat away from the first heat sink to the second heat sink which in turn conducts it to, and distributes it over, an area on the inside surface of the trim. Under steady state conditions, substantially all, or at least a major portion, of the heat generated by the LED passes by thermal conduction through the trim from whose outside surface it is liberated to the external ambient environment.

BACKGROUND OF THE INVENTION

Recessed lighting fixtures are versatile and popular for a variety of indoor and outdoor illumination applications and are widely used for general illumination, architectural lighting, accent lighting, task lighting and underwater lighting. Their popularity stems in large measure from the fact that in addition to being able to provide a level of illumination appropriate to a particular application, the bulk of a recessed fixture is concealed in or behind the recess in which it is mounted. As such, they are unobtrusive, occupy little or no space in the area being illuminated, and can cast light outward from behind, flush with, or close to a surface so that substantially the entire region forward of the surface can be lighted.

Recessed lighting fixtures have two main parts, which are typically referred to in the lighting industry as the "trim" and the "housing". The housing is the portion that is installed in a recess which at least partially penetrates a wall, ceiling, stair riser, bollard or other architectural structure. Typically, all or most of the housing is substantially concealed within the recess by the trim after the fixture has been installed.

The trim is generally the part of a recessed fixture that is most visible after the fixture has been installed in a recess opening and it often has a decorative appearance. Trim can be highly ornamented or of an unobtrusive style that is intended to blend in with its surroundings in an understated manner. In recessed ceiling-mounted fixtures for example, the trim often takes the form of a low-profile ring having an aperture in the middle from which the illumination emanates. The aperture can simply be an uncovered opening or, it can be fitted with a transparent or translucent cover known as a "lens". As used in the lighting industry, the term "lens" can encompass, but is not limited to, an element that focuses, de-focuses or re-directs light and/or one that has an axis of symmetry.

In addition to holding the illumination source or "lamp", an important function of the housing of a conventional recessed lighting fixture is to safely dissipate enough of the heat given off by the lamp to prevent a fire hazard. Although it is common to also include a thermal safety switch as backup protection recess, mounted lighting fixtures generally depend heavily on direct convective exchange between the exterior ambient environment and spaces inside and/or around the recessed portion of the housing in order to keep the temperature of the components of the fixture within safe and otherwise acceptable limits.

In the case of a recessed indoor ceiling-mounted lighting fixture, the recess opening is usually a hole which completely penetrates the ceiling drywall and the housing mounts mostly above the hole in the space above drywall. In the United States, housings for those types of fixtures are classified as either "IC" or "Non-IC". Type IC (for "insulation contact") housings are primarily used for new construction housings and are generally fastened to the ceiling joists before the drywall or other ceiling material is installed. Building codes allow IC housings to directly contact building insulation material but are typically rated for use with lamps of not more than about seventy five watts (75 W).

Non-IC rated housings can be rated to safely accommodate lamps of up to about one hundred fifty watts (150 W) but can be used in compliance with most building codes only if a minimum spacing of about three inches or more is present on all sides between the housing and any insulation. Recessed lighting fixtures with non-IC rated housings can be installed before installation of the ceiling panel but are also available in configurations which can be installed by passing the housing through a hole cut in the ceiling and are ideal for retrofit applications in a ceiling.

In other applications, such as recessed light fixture or luminaire to be mounted in a recess in a bollard, pool, fountain, garden wall, or stair riser of an outdoor stairway, the recess opening typically does not completely penetrate the structure but instead terminates so that the recess takes the form of a niche which is closed-off on all but one side. Such applications can be particularly challenging, even with fixtures using conventional lamps, since little free space or convective circulation may be available within the confines of the niche to adequately cool the fixture. They are made even more difficult if one wishes to meet the needs of applications in which it would not be possible, or would be undesirable, to provide the trim with vents capable of permitting substantial convective flow to take place through the aperture or other parts of the trim, to transfer heat by convection from the housing to the ambient environment which interfaces with the exterior of the trim. They are made more challenging still if one wishes to address such applications while at the same time providing energy savings which are offered by using energy efficient light emitting diodes as a light source rather than an incandescent bulb or other conventional lamp.

Conventional incandescent bulbs produce light by passing an electric current through a thin filament which is heated by the current until it glows brightly. LED's produce light by a completely different mechanism. An LED is a semiconductor device, namely a diode junction between a p-type semiconductor material and n-type semiconductor material. As an electric current is passed in the forward direction across the p-n junction of an LED, photons are given off as electrons making up the flow of current change their energy levels, thus producing light. This process, called electroluminescence, is an efficient way of generating light from electricity, particularly in comparison to incandescent bulbs and many other types of lamps. However, it is not a process which results in 100% conversion of electrical energy into light. A significant fraction of the energy represented by the electric current flowing through an LED generates heat rather than light. If sufficient amounts of heat are not carried away from the area of the p-n junction at a sufficient rate, it will cause the operating temperature of the LED to rise to an unacceptably high temperature which could cause the LED to fail prematurely. Thus, unlike incandescent bulbs and certain other technologies such as high intensity discharge (HID) lamps, which not only tolerate but require extreme temperatures in order to generate light, LED's are relatively intolerant of high temperatures, particularly if one desires to maximize the operating life if the LED.

In order to carry away enough heat, light fixtures and luminaires for general and architectural illumination using LED's typically rely at least in part on convection in the immediate vicinity the LED to help carry away enough the excess heat generated by the LED. However, in the case of recessed lighting in particular, designers and architects cannot always rely on there being sufficient space and/or ventilation available in the recessed area behind the trim of the fixture where the LED is located. For example, there may be thermal insulation present in the area behind the recess opening which impedes convective flow as well as conduction of heat from the recessed portion of the fixture. To compensate for this, the trim is typically provided with one or more vent openings that allow convection currents to pass through the trim to cool the lamp and other areas behind the inside surface of the trim. In many cases, such vent openings consist of or include the aperture in the trim through which the illumination is delivered. However, it is not always possible or desirable to provide vent openings through or behind the trim of a recessed fixture or luminaire. For example, in certain wet or underwater applications, it may be necessary or desirable to seal off the trim and/or at least the LED, to isolate internal components from environment which adjoins the outside surface of the trim in order to provide such components with mechanical protection and/or prevent the intrusion of water into them. Such constraints on heat removal have resulted in limitations as to either or both: (i) the degree to which fixtures and luminaires of this type can be effectively sealed against intrusion of fluids and/or (ii) their total maximum wattage and thus, the amount of light they can provide.

SUMMARY OF THE INVENTION

According to a preferred embodiment, an LED recessed lighting apparatus has a housing that mounts in a recess located behind a recess opening in a wall, ceiling or other architectural structure. A non-vented trim is securable in place over the recess opening. A lens that allows light from the LED to pass through the trim has a fluid-tight internal cavity within which is disposed at least the light-emitting portion of the LED. At least a major portion of the heat generated by the LED is carried directly from the LED to the outside surface of said trim by way of a thermal path that includes a first heat sink mounted substantially immediately adjacent to and intimately thermally conductively coupled to the LED, at least one second heat sink mounted substantially immediately adjacent to and intimately thermally conductively coupled to the inside surface of the trim, and at least one heat pipe mechanically and thermally coupling the first heat sink to the second heat sink.

This structure provides a thermal path having low thermal resistance and high heat carrying capacity that substantially directly thermally couples the LED to the exterior of the trim where it can liberated to the ambient environment in sufficient quantities and at a sufficient rate to not only maintain the housing at suitably low safe temperature to avoid a fire hazard but also to keep the operating temperature of the LED within its maximum rating and thereby avoid shortening the life expectancy of the LED. The first heat sink is sufficiently intimately thermally conductively coupled to, and is in close proximity distance-wise to the LED, and has sufficient heat capacity to be able to take on enough heat sufficiently quickly after the LED is first energized to keep the LED at an acceptably low temperature during any thermal lag interval that exists until heat begins to drain downstream from the first heat sink at an adequate rate.

Since the fluid-tight cavity protects the LED, the apparatus is particularly well-suited for wet, outdoor and/or underwater applications such for projecting illumination from garden walls, the risers of stairs in outdoor walkways, or the sidewalls or bottoms of pools, fountains or other water features, in either a wet niche or a dry niche.

DETAILED DESCRIPTION OF A PREFERRED EMBODIMENT

Figure 1:
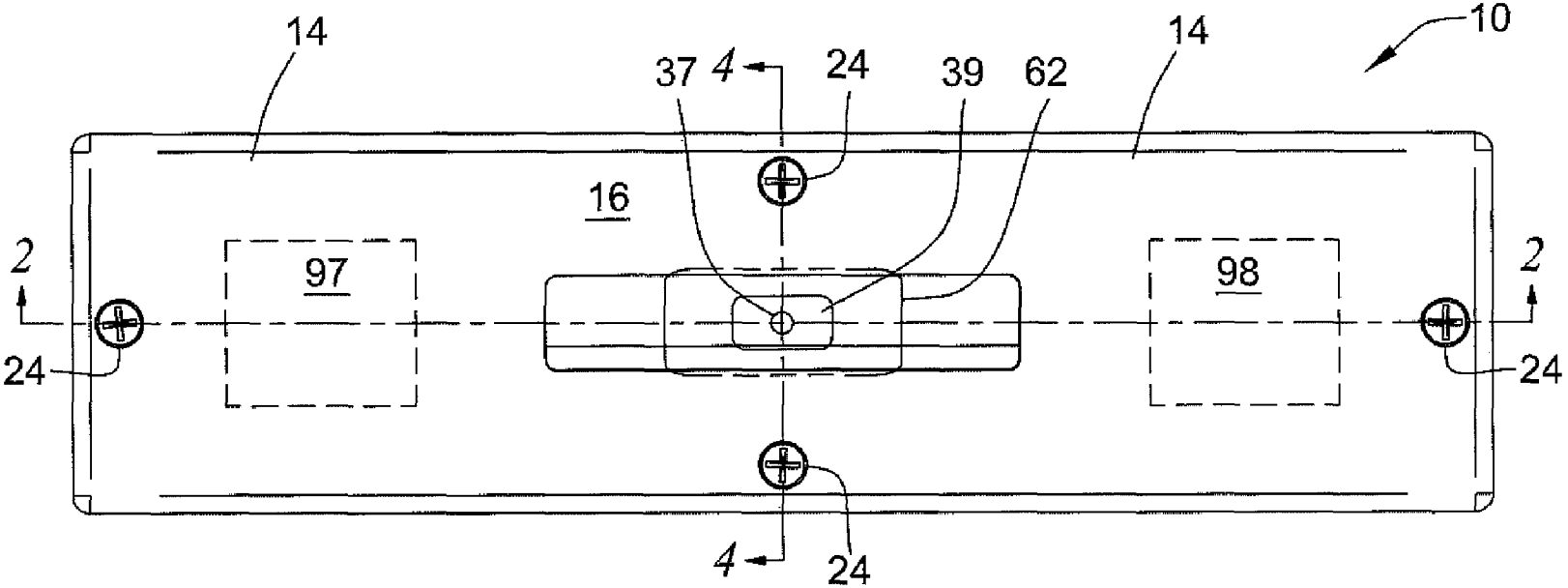
FIG. 1 is a front elevational view of a preferred embodiment of a lighting apparatus constructed according to the invention.

Referring collectively to FIGS. 1 through 4, a preferred embodiment of a thermally managed LED lighting apparatus 10 constructed according to the present invention includes a housing 12, and a trim which comprises a non-vented trim 14. The housing 12 mounts in a recess 13 located behind a recess opening 17 formed in an architectural structure 19. By way of non-limiting example, architectural structure 19 may be a wall, ceiling, stair riser, pool, fountain, water feature, or bollard and may be located either indoors or outdoors, above water or below. The trim, namely non-vented trim 14, trims the recess opening 17 and generally conceals all or most of housing 12 and the edge(s) of the recess opening 17 after trim 14 is installed.

Trim 14 has an inside surface 15 and a substantially planar outside surface 16. The housing 12 at least partially encloses an interior space 18 within housing 12 and has a front opening 20 adjoining interior space 18. The non-vented trim 14 is securable to the housing 12 to present an attractive finished appearance and block the front opening 20 after installation such that the inside surface 15 of non-vented trim 14 adjoins the interior space 18 within the housing 12 when non-vented trim 14 is installed. Non-vented trim 14 is not penetrated by vents or openings that could allow water spray or an object or debris of significant size to pass through the trim into contact with internal wiring connections or other parts inside surface housing 12 when the trim is secured to housing 12. As the term is used herein, "non-vented" can be, but need not necessarily be, a structure that allows trim to block opening 20 in a fluid-tight or substantially fluid-tight manner, but is at least such that the interior space 18 within the housing 12 is substantially isolated from direct convective thermal exchange with the external environment that meets the outside surface of the trim 14. The term "fluid" as used herein encompasses liquid and/or gas and/or combinations and/or mixtures thereof.

Trim 14 can be secured to housing 12 in any conventional manner, preferably one that permits trim 14 to be selectively detached from housing 12 or opened if necessary for purposes of inspection, maintenance or repair of apparatus 10. For example, trim 14 can be connected to housing 12 using a conventional hinge and latch arrangement (not shown) and/or using one or more mechanical fasteners such as screws, bolts, rivets, springs, clips or the like. Trim 14 need not be affixable directly to housing 12, as is the case in the preferred embodiment shown in the drawings, but can also be affixable by screws, clips, rivets, springs or the like in any conventional manner so that at least a portion of the trim 14 is affixable over the recess opening 17.

Figure 2:
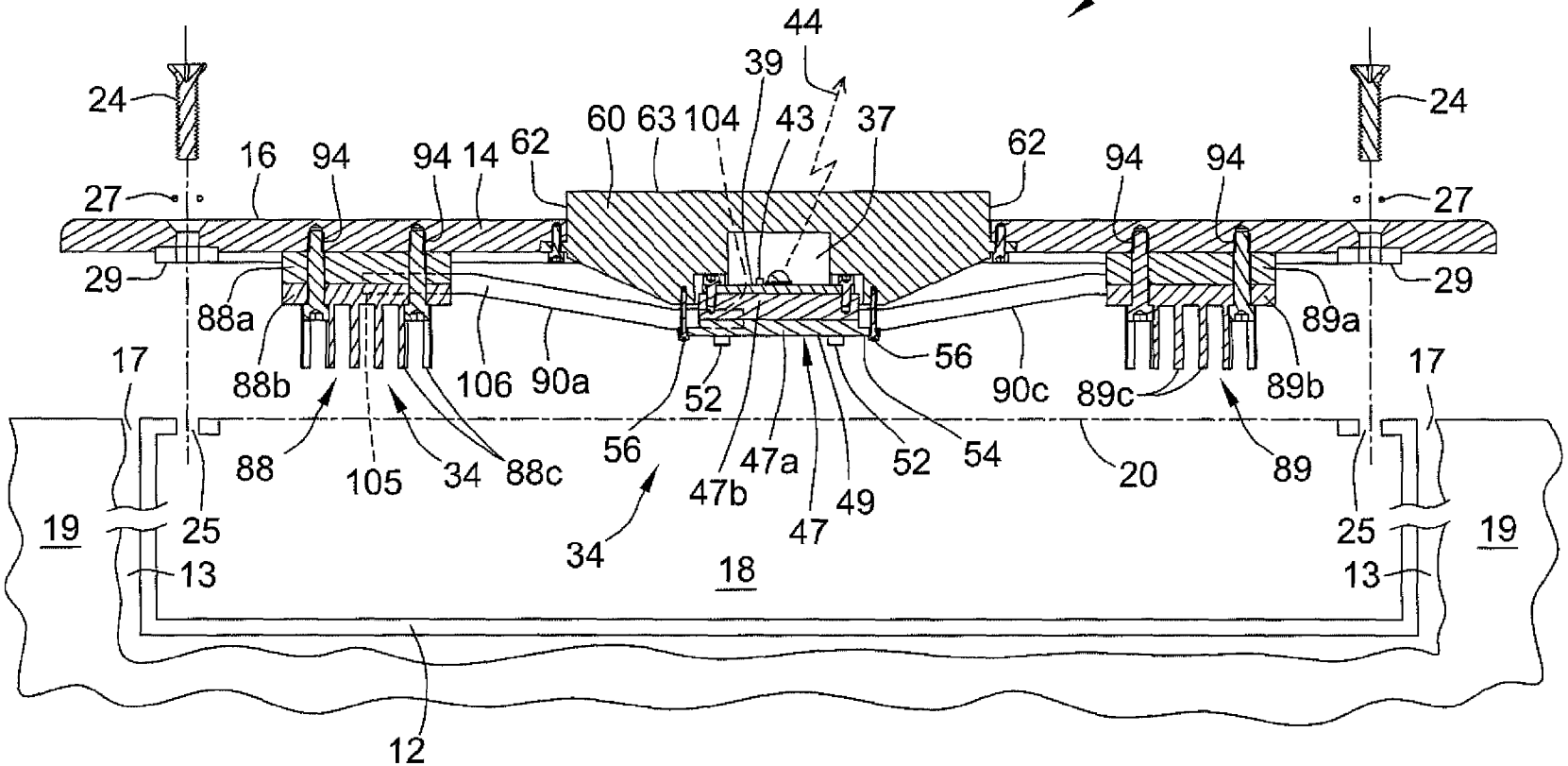
FIG. 2 is a sectional view taken along line II-II of FIG. 1.

In the preferred embodiment illustrated, trim 14 is provided with a plurality of screws 24 that engage holes 25 in a peripheral flange 26 which forms part of housing 12 in the area surrounding opening 20. To provide an optional fluid sealing, O-rings 27 may be provided between the trim 14 and the heads of screws 24, and a peripheral seal 29 such as a gasket or bead of sealant may be provided between trim 14 and flange 26 and/or the periphery of recess opening 17 as shown in FIG. 2 to prevent intrusion of water or other liquids into the interior space 18 of housing 12 and/or into recess 13.

Trim 10 carries, or may optionally form part of, a mechanically self-supporting lighting module 34 which at least one light-emitting diode LED 37. As used herein and in the claims, the term LED is to be broadly construed and includes light emitting diodes made using either organic materials, such as OLED's and/or PLED's or inorganic semiconductor materials and is also intended to encompass laser diodes as well as LED devices that emit non-coherent light of any wavelength or combination of wavelengths. The term "LED" also encompasses devices having either an individual LED or an array of LED's. LED 37 is mounted supportably to and substantially directly thermally coupled to a substrate 39, either directly or indirectly by way of one or more thin layers of electrically insulating but thermally conductive layers such as a thin sheet of mica and/or a layer of thermally conductive grease of the type commonly used in the electronics industry to improve heat transfer between semiconductor devices and heatsinks. Substrate 39 may suitably comprise a circuit board having one or more electrically conductive paths 41, 42 and/or a driver circuit 43 for supplying sufficient electrical energy to the LED 37 to enable it to emit a desired amount of light for a particular application.

Figure 3:
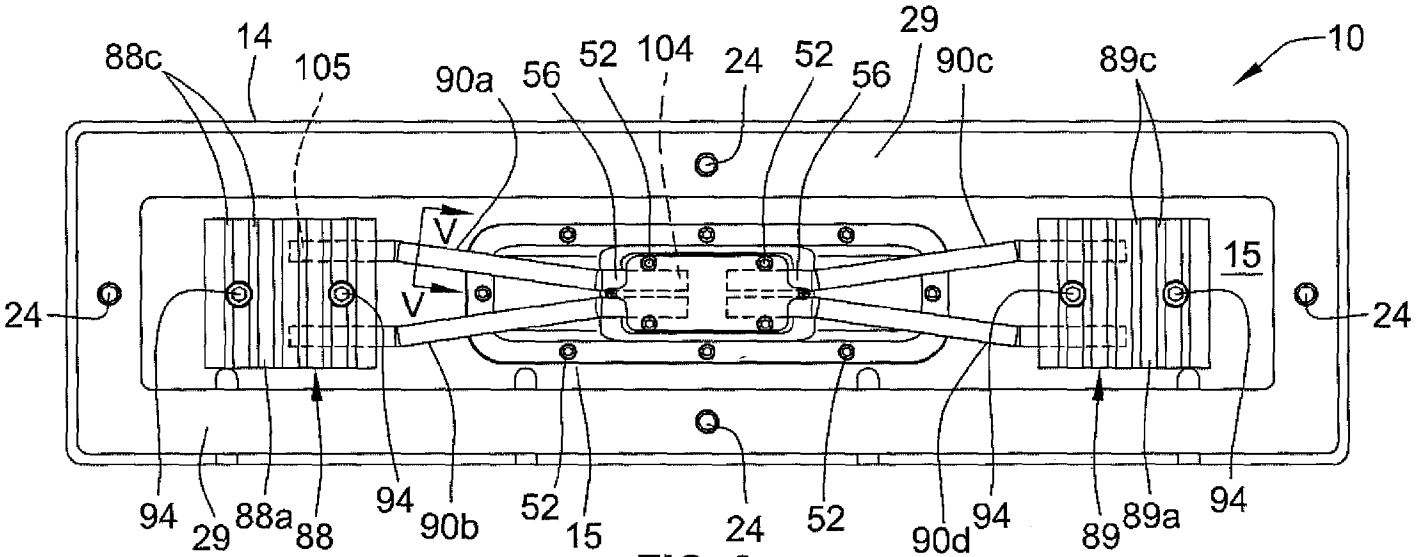
FIG. 3 is a rear elevational view of the embodiment of FIG. 1.

Lighting module 34 also includes a first heat sink 47 which is formed of two blocks 49 and 50 of highly thermally conductive material such as an alloy of copper or anodized aluminum which are clamped to one another by way of four cap screws 52 to form a substantially unitary thermal mass. First heat sink 47 is formed of a highly thermally conductive material such as an alloy of aluminum (preferably anodized for corrosion protection) or copper and has sufficient thermal mass to keep the temperature of LED 37 acceptably low during the lag period which occurs between the time LED 37 is first energized and such later time that the temperature of the first heat sink 47 stops rising as a result of shedding heat to elements downstream in the thermal path. As shown in FIGS. 2 and 3, block 50 includes a pair of ears 54 which project outwardly a short distance from its midregion and are penetrated by a pair of screws 56 which attach the first heat sink 47 to a lens 60, which forms a further part of lighting module 34.

Lens 60 is mounted in optical alignment with an aperture 62 formed in a central portion of trim 14 and may be of any transparent or translucent material suitable for allowing at least a portion of the light energy 44 emitted from LED 37 to pass through the lens 60 and beyond the outside surface 16 of trim 14 for illuminating an area located exteriorly of trim 14. Lens 60 can be of any of a diverse variety of materials including but not limited to a tempered or non-tempered glass, laminated or non-laminated resins or thermoplastics such as polycarbonate, polystyrene or acrylic. Lens 60 may also be of a composite of any two or more such materials, such as one having one or more layers of plastic captured between one or more layers of glass to impart resistance to shattering. For high temperature applications, or applications where lens 60 may be subjected to sudden extreme temperature changes, such as those that might occur if a lens 60 already hot from operation and/or sun exposure is suddenly sprayed with rain or a cleaning solution, a material having a low coefficient of thermal expansion can be used to avoid shattering of lens 60 due to thermal stress. Such materials include borosilicate materials such as those readily commercially available from a number of sources including for example Corning 7740 glass and others available from Corning Inc under the brand name Pyrex® and Schott Glass 8830 glass and others available from Schott Glass under the brand name Duran®.

Lens 60 may be formed using any of a variety of processes, the selection of which will depend primarily on the selection of its material and particular final shape and mechanical and optical properties desired. Glass materials are typically formed into shape by molding or casting. Thermoplastics can be processed into a desired shape in any of a variety of ways including processes such as injection molding, extrusion vacuum forming and machining. Lens 60 can also be formed by flowing a hardenable liquid material such as a mixture including a resin and a catalyst into a mold.

If desired, all or any part(s) of lens 60 can be colored or otherwise treated to alter the wavelength or other optical characteristics of the light emitted from apparatus 10. This can be achieved for example by fabricating lens 60 from a colored material, or by adding a coloring agent to the base material from which lens 60 is to be cast or molded. It is also an option to provide the front surface 63 of lens 60 with a coating or an applied film layer which could either be clear, colored and/or if desired, have special optical characteristics. For example, such a layer or coating could optionally comprise a polarizing filter or a non-polarizing filter. In the preferred embodiment however, lens 60 is substantially clear and uncolored. It is also to be appreciated that lens 60 may optionally be etched, "frosted" or provided with any other desired surface finish or texture. Such surface finish or texture can be formed during a molding or casting process by fabricating a surface to include a surface finish or texture that is imparted directly to the lens. Alternatively, such a texture or finish can be provided by carrying out a secondary operation on surface 63 or some other surface of lens 60, such as blasting a surface of lens 60 with an abrasive media, or applying a chemical etching agent to that surface, or applying a coating to the surface. Glass surfaces for example can be surface etched by applying certain acids.

Lens 60 may, if desired, be shaped or otherwise adapted to refract focus, or defocus or change the direction of the light 44 emitted from LED 37 in a particular manner and/or to alter its wavelength or other optical characteristics. For example in the preferred embodiment, lens 60 includes a beveled surface for directing some of the light emitted by apparatus 10 at a downward angle. However, it is to be understood that the term "lens" as used herein and in the claims can be, but is not limited to a structure capable of focusing, defocusing and/or changing the direction, wavelength, polarization or other characteristics of light, or a structure that has an axis of symmetry or has optical characteristics beyond an ability to allow at least some of the light from LED to pass through at least a portion of lens 60 itself so it can illuminate an external area outside surface the outside surface 16 of trim 14. In the preferred embodiment, lens 60 is mounted in aperture 62 such that a portion 64 of lens 60 projects outward beyond the outside surface 16 of trim 14. However, the invention is in no way limited to such an arrangement. Nothing in this specification, the drawings or the claims are to be construed as requiring that any portion of lens 60 extend outwardly beyond outside surface 16 of trim 14. Lens 60 can alternatively be configured to have its front surface 63 located substantially flush with the outside surface 16 of trim 14, or located between the inside surface 15 and outside surface 16 of trim 14, or substantially flush with inside surface 15 of trim 14, or behind inside surface 15 of trim 14. Rather than forming them as initially separate parts which are later joined together, lens 60 and trim 14 can be molded or otherwise formed together as a unitary structure.

Figure 4:
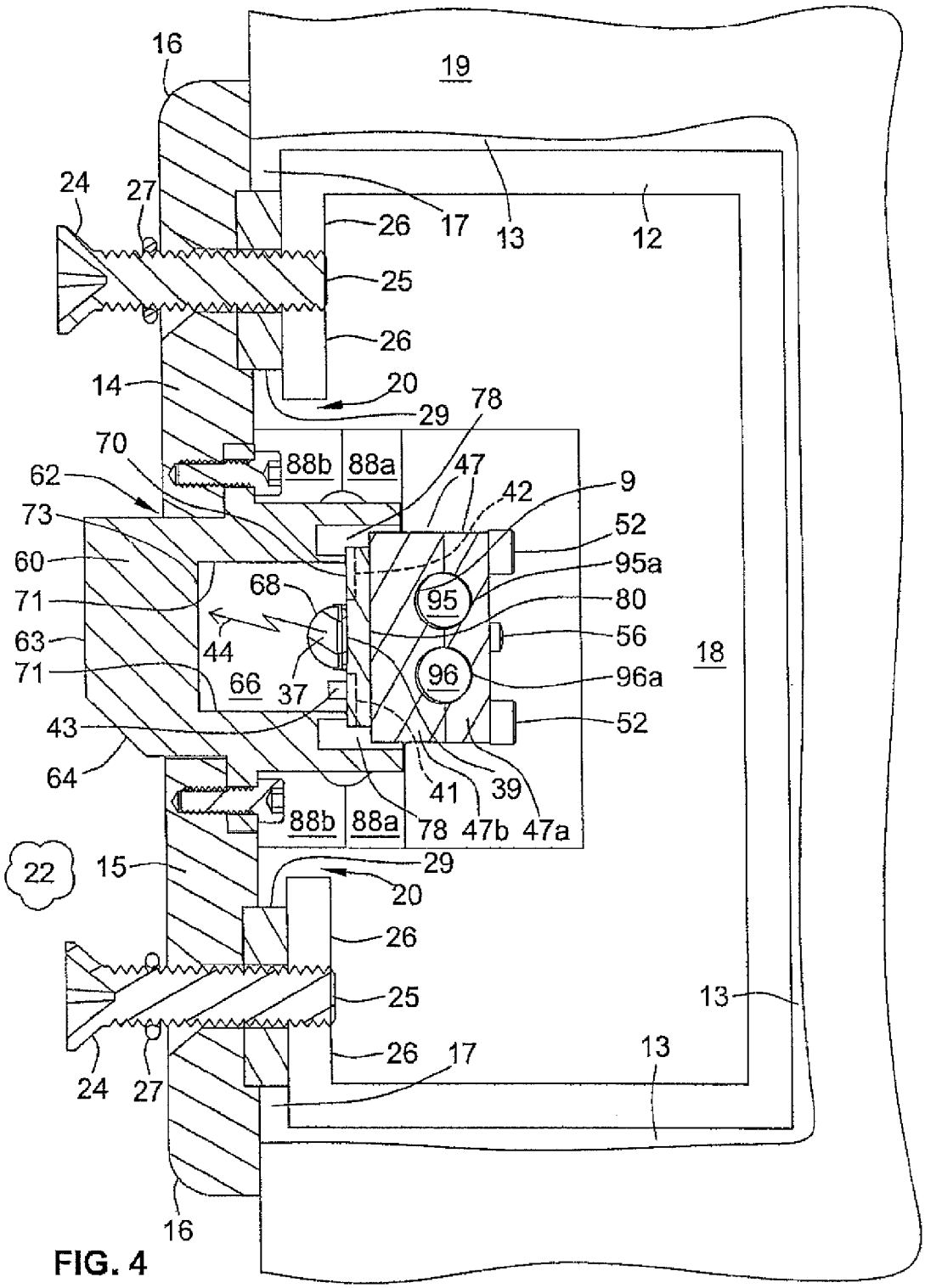
FIG. 4 is a sectional view taken along line IV-IV of FIG. 1 and illustrating the mounting of the preferred embodiment of FIG. 1 in a recess of an architectural structure.

Lens 60 includes a cavity 66 inside surface of which LED 39, or at least the light emitting portion 68 of LED 37, is located. LED 37 is supportably mounted on thermally conductive substrate 39 either in direct physical contact with substrate 37, or more preferably by way of a very thin intermediate layer of thermal grease (not shown), in order to make the thermal resistance between LED 37 and thermal substrate 39 as low as reasonably practicable. Regardless of the structural particulars of the mounting arrangement as person of ordinary skill in the art may later select in light of this disclosure, the objective is to mount LED 37 and substrate 39 as closely to one another as possible, both distance wise and thermally. LED 37 and substrate 39 are substantially directly thermally conductively coupled to one another and are mounted in substantially immediate proximity to one another. Ideally, LED 37 and substrate 39 should have very smooth mating surfaces that make direct surface-to-surface contact with one another, preferably over as large an area as possible. Not more than a short distance should exist between them at their closest points. Any structure(s), such as a layer of thermally conductive grease and/or an electrical insulator such as a thin wafer of mica (not shown), that may be interposed between LED 37 and substrate 39, should be thin and highly thermally conductive. As shown in FIG. 4 substrate 39 and at least a portion of driver circuit 43 may be located inside sealed cavity 66 to protect them from mechanical damage and intrusion of fluids.

LED 37 is preferably mounted so that it does not contact the walls of cavity 66 or any other parts of lens 60. Cavity 66 is bounded at its rear by a portion of the upper surface 70 of substrate 39. Cavity 66 is bounded at its sides and front by side walls 71 and a front wall 73, respectively. The space within cavity 66 is preferably filled with only dry air, nitrogen, an inert gas or can even be evacuated if desired. The space within cavity 66 thus serves as thermal insulation keeps the amount of heat transferred from LED 37 to lens 60 relatively low thus keeping down its maximum normal operating temperature. This widens the range of materials available to designers and opens the possibility allowing lens 60 to be made from materials having lower temperature ratings, and therefore lower cost, than would otherwise be the case. It can also help in avoiding premature weakening, cracking and/or discoloration of the lens material due to heat aging effects to which certain materials would otherwise be vulnerable.

However, lowering the maximum steady-state operating temperature of lens 60 is not the only thermal benefit afforded by cavity 66. The insulating effect of the space inside surface cavity 66 also slows the rate of the temperature rise of lens 60 after LED 37 is turned on. This helps to prevent lens 60 from cracking due to thermal stress. This is particularly important if lens 60 is not made of a material such as borosilicate glass which has a low coefficient of thermal expansion.

In the preferred embodiment, cavity 66 is at least substantially "fluid-tight", meaning that it is sufficiently sealed against fluid ingress and/or egress that there is substantially no fluid flow into, or out of, cavity 66 under normal operating conditions associated with the particular intended use that a given embodiment of the invention is adapted. In the preferred embodiment, cavity 66 is made fluid-tight by providing a seal 78 which lies between lens 60 and substrate 39 and surrounds the entire periphery of substrate 39. As shown in FIG. 4, seal 78 extends beyond the width of substrate 39 on both sides of substrate 39 in the direction that corresponds horizontal in FIG. 4 so that seal 78 also peripherally surrounds the edge of the entire joint 80 by way of which the block 49 of the first heat sink 47 and substrate 39 are substantially directly thermally conductively coupled to one another. If desired, a heat transfer enhancing agent such as thin layer of thermal grease may be interposed to reduce the thermal resistance between the block 49 of first heat sink and substrate 39.

Seal 78 is preferably formed in situ by flowing a hardenable sealant or adhesive such as an epoxy or a silicone material into the areas where seal 78 is shown in FIG. 4 and allowing the material to cure. For some applications, it is also possible to form seal 78 using a thermoplastic sealant or thermoplastic adhesive material of the type which are heated to a liquid or semi-liquid state for application and solidify upon cooling. Sometimes referred to as "hot melt" adhesives or sealants, a wide variety of such materials are readily commercially available and can be selected to meet the needs of a particular application.

From the foregoing, it will be appreciated that because substrate 39 is intimately thermally conductively coupled to, and located substantially immediately adjacent proximity to, LED 37 on its one side, and first heat sink 47 on it its opposite side, LED 37 and first heat sink 47 are themselves intimately thermally conductively coupled to one another and are located substantially immediately adjacent to one another.

In addition to first heat sink 47, lighting module 34 further includes at least one second heat sink 88 and at least one heat pipe 90*a*, which serves to mechanically and thermally couple the first heat sink 47 and the second beat sink 88 to one another and to the inside surface 15 of trim 14. The preferred embodiment includes two (2 ea.) second heatsinks 88, 89 and a total of four (4 ea.) heat pipes 90*a*, 90*b*, 90*c* and 90*d* each form highly efficient thermal conduits which transfer heat away from first heat sink 47 to second heatsinks 88 and 89. More specifically, a first pair of heat pipes 90*a* and 90*b* provides a low thermal resistance coupling of first heat sink 47 to second heat sink 88. In the preferred embodiment, heat pipes 90*a* and 90*b* are thermally in parallel with one another and form a first bifurcated thermally conductive link which thermally couples first heat sink 47 to second heat sink 88. Each one of a second pair of heat pipes 90*c* and 90*d* provides a low thermal resistance, high thermal flow capacity thermal coupling of first heat sink 47 to second heat sink 89 and are also thermally paralleled with one another. Heat pipes 90*c* and 90*d* form a second parallel thermally conductive link 92 thermally connecting heatsinks 47 and 89 to one another.

Second heatsinks 88, 89 are each formed of two blocks, 88*a*, 88*b* and 89*a*, 89*b*, respectively of highly thermally conductive material, such as an alloy of copper or anodized aluminum, which are clamped to one another by way of cap screws 94 so that heatsinks 88 and 89 are each a substantially unitary thermal mass. Second heatsinks 88 and 89 are each also spaced apart from first heat sink 47 as well as from one another. Second heatsinks 88, 89 are attached to the inside surface 15 of trim 14 at locations 97 and 98 positioned on opposite sides of first heat sink 47. Locations 97 and 98 are shown in FIG. 1 by correspondingly numbered boxes which are drawn in dashed lines to indicate that locations 97 and 98 are on the inside surface of trim 14, rather than on its outside surface 16. Preferably, locations 97 and 98 are sufficiently spaced apart from one another so that the inherent thermal resistance associated with the region of the body of trim 14 which lies between locations 97 and 98 provides an amount of thermal resistance between heatsinks 88 and 89 that prevents, or at least mitigates, undesirable thermal interactions between second heatsinks 88 and 89 which would otherwise degrade the efficiency of heat transfer from second heatsinks 88, 89 to trim 14. Due to the spacing, a lower rise in temperature occurs at location 97 because less heat is conducted through trim 14 from location 98 than would be the case if heatsinks 88 and 89 were closely adjacent one another. Conversely, the spaced configuration just described also limits the rise in temperature at location 98 resulting from what would otherwise be a greater amount of heat conducted through trim 14 from location 97. This allows fall advantage to be taken of the ability of trim 14 to absorb heat from both second heatsinks 88 and 89 and liberate that heat to the external environment 22 which interfaces with the outside surface 16 of trim 14. Second heat sink 88 and 89 also serve to conduct heat from themselves to trim 14 over a substantial surface area as represented by the area inside locations 97 and 98. This allows the trim 14 to take on heat from the second heatsinks 97 and 98 at an acceptably high rate even if the trim is of a material having a lower thermal conductivity than the second seat sinks 97 and 98 themselves.

Optionally, either or both second heatsinks 88, 89 may be provided with a plurality of surface area enhancing fins 88*c*, 89*c* which may serve to either give up or take on heat from the interior space 18 inside housing 12 depending on the prevailing direction of the thermal gradient existing at a given time. For at least a substantial time after LED 37 is first energized the air (or water in the case of a wet niche application) inside interior space 18 within housing 12 will normally be cooler than the fins 88*c*, 89*c*. This helps to steepen the downstream thermal gradient along the portion of thermal path 85 between LED 37 and second heatsinks 88, 89 and is thus accelerates the overall transfer of heat away from LED 37. If, after LED 37 has been energized for a period of time, the interior space 18 inside housing 12 becomes warmer than fins 88*c*, 89*c*, the temperature gradient between the fins 88*c*, 89*c* will be in the reverse direction from that just described thus allowing fins 88*c*, 89*c* to help cool the interior space 18 within housing 12, thus helping to regulate the temperature inside space 18.

As can be seen from FIG. 2, the screws 94 which secure second heatsinks 88 and 89 are each adapted to be mechanically coupled to, and intimately thermally conductively coupled to, the inside surface 15 of trim 14. In the preferred embodiment this is achieved by providing the lower faces of blocks 88*a* and 89*a* with a profile that mates flush at all points with the inside surface of trim 14 and providing blocks 88 and 89 with holes which receive screws 94 that partially penetrate trim 14. To further assure intimate thermally conductive coupling of second heatsinks 88 and 89 to trim 14, their respective interfacing portions may be provided with a smooth surface finish and/or joined by way of a heat transfer enhancing agent such as a thin layer of thermally conductive paste. If desired, a heat transfer enhancing agent such as a thin layer of thermally conductive paste can also be interposed between at least the second blocks 88*b* and 89*b* of second heatsinks 88 and 89 and the respective locations at 97, 98 at which they are intimately thermally coupled to the inside surface 15 of trim 14. Alternatively, it is also possible to weld or clamp second heatsinks 88, 89 to trim 14. Another option is to initially form trim 14 and at least the blocks 88*a* and 89*a* as a unitary structure. This can be done for example in a casting or molding process such as a metal die casting process, or a powdered metal sintering process. Aluminum die castings for example, afford excellent thermal conductivity and can be decoratively and protectively surface-finished in a variety of ways such as by anodizing, painting, powder coating or the like.

In order to thermally conductively couple and mechanically secure heat pipes 90*a* and 90*b* to first heat sink 47, the side of heat sink 47 nearest second heat sink 88 is provided with a pair of generally cylindrical channels 95, 96 which are formed by two grooves 95*a*, 96*a* of generally semicircular cross-section formed in block 47*a* and a mating pair of correspondingly shaped grooves 95*b*, 96*b* formed on block 47*b*. The first end 104 of heat pipe 90*a* is received inside surface channel 95 where, under clamping pressure provided by screws 52 it is held securely in place in intimate thermal contact with the walls of grooves 95*a* and 95*c* and is thereby substantially directly thermally coupled to first heat sink 47*a*. The corresponding ends of parallel heat pipe 90*b* is connected to heat sink 47*a* in the same fashion by way of channel 96.

As noted above, heat pipes 90*a* and 90*b* run thermally in parallel with one another and mechanically and thermally couple first heat sink 47 to second heat sink 88. Correspondingly, heat pipes 90*c* and 90*d* run thermally in parallel with one another and mechanically and thermally couple first heat sink 47 and second heat sink 89. In the preferred embodiment, second heatsinks 88 and 89 are identical mirror images of one another and all of the heat pipes 90*a*, 90*b*, 90*c* and 90*d* are themselves identical to one another. Therefore, for the sake of clarity of illustration, only second heat sink 88 and heat pipe 90*a* are discussed below since they are typical of their respective counterparts 89 and 90*b*, 90*c* and 90*d*.

Figure 5:
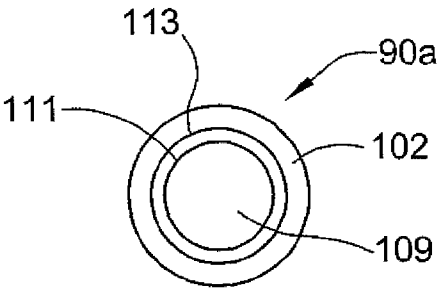
FIG. 5 is a sectional view taken along line V-V of FIG. 3.

Heat pipe 90*a* is typical of heat pipes 90*a*-90*d* and is preferably a passive heat pipe, as shown in cross section in FIG. 5. In the preferred embodiment, heat pipe 90*a* is formed of a closed cylindrical metal tube 102 having a first end 104 and a second end 105 which are separated by an intermediate central portion 106. A hollow internal channel 109 which is sealed to contain a quantity of a working fluid (not shown). Channel may be at least partially evacuated in order to lower its internal pressure to facilitate phase change of the working fluid. A portion of the working fluid is typically in a liquid phase and a portion of which is a vapor phase during operation. A tubular wick 111 is disposed inside surface the metal tube 102, running along its length in direct contact with the interior wall 113 of the metal tube 102 to provide a fluid transport path for liquid phase working fluid. When a first end of tube 102 which serves as an evaporator portion 104 of heat pipe 90*a* is heated, the heat enters by thermal conduction though the wall of the metal tube 102. The heat increases the temperature of the working fluid at the evaporator portion 104, causing some of the liquid working fluid on the wick 111 in the region of the evaporator 104 to vaporize, taking on heat. The working fluid vapor is transported via channel 109 to the second end of tube 102 which operates as a condenser 105 of the heat pipe 90*a* due to its thermal contact with second heat sink 88, condenser 105 is at a lower temperature than the evaporator 104. This causes some of the working fluid vapor to condense back into liquid phase onto the wick 111, and in doing so, give off heat which passes out of the heat pipe 90*a* and into second heat sink 88 by thermal conduction though the wall of the metal tube 102 in the region of second end 105. The condensed liquid phase working fluid is then transported along the wick from the condenser 105 back to the evaporator 104 to be vaporized once again. Thus, heat pipe 90*a* provides a thermal path though which heat is carried from the evaporator 104 to the condenser 105 though the recirculation process just described which continues, as long as the evaporator 104 of heat pipe 90*a* is sufficiently warmer than the condenser 105, and requires no external energy input beyond the heat being transported.

Heat pipes 90*a*, 90*b*, 90*c*, and 90*d* are each capable of carrying substantial amounts of heat from first heat sink 47 to second heatsinks 88 and 89, respectively over relatively long distances with very low thermal resistance. The total heat flux out of first heat sink 47 is multiplied by providing two (2 ea.) second heatsinks 88, 89 which are thermally coupled to the inside surface 15 of trim 14 at mutually spaced areas 97, 98 and by thermally coupling first heat sink 47 of the second heatsinks 88, 89 though a pair of heat pipes 90*a*, 90*b*, and 90*c*, 90*d*, respectively connected thermally in parallel with one another. Rather than as two separate sealed units, heat pipes 90(*a*) and 90(*c*) can alternatively be formed as one continuous sealed tube 102 with a continuous internal wick 111 therein, both passing completely through first heat sink 47 by way of one continuous channel 95. Likewise, heat pipes 90(*b*) and 90(*d*) can alternatively be formed as one continuous sealed tube and wick structure passing completely through first heat sink 47 by way of one continuous channel 96.

In operation after apparatus 10 has been installed in a recess 13 with trim 14 affixed over at least a portion of recess opening 17 as shown in FIG. 4 and LED 37 initially energized by way of electrical wiring connections (not shown) coupled to conductive paths 41 and 42 and driver circuit 43, LED begins to emit light 44 which passes through the aperture 62 in trim 14 and through the front surface 63 of lens 60 to illuminate an area lying exteriorly of the outside surface of trim 14. The temperature of LED 37 begins to rise rapidly but a large fraction of the excess heat generated by LED is rapidly transported by thermal conduction to first heat sink 47 by way of the substrate 39 on which LED 37 is mounted, which causes the temperature of first heat sink 47 to begin to rise.

During the thermal lag period which occurs before heat can begin to be drained from first heat sink 47 and passed further downstream in the thermal path at a rate at least as rapid as that at which heat is entering first heat sink 47, the first heat sink 47 takes on and stores enough heat from LED 37 at a sufficiently rapid rate to prevent LED 37 from exceeding maximum operating temperature as typically specified by the LED manufacturer.

Heat from first heat sink 47 is carried to second heatsinks 88, 89 by heat pipes 90*a*, 90*b*, 90*c* and 90*d* at an overall rate which soon climbs high enough to prevent any further significant temperature rise of first heat sink 47 and thus, LED 37.

Heat from second heatsinks 88 and 89 is thermally conductively transferred to the trim 14 by way of locations 97 and 98. Locations 97 and 98 are sufficiently mutually spaced apart from one another that the inherent thermal resistance of trim 14 in the region between locations 97 and 98 prevents, or at least reduces, the extent to which local heating of trim 14 by one of second heatsinks 97 or 98 impedes the transfer of heat from the other one of those heatsinks 97 or 98 to the trim.

After being thermally conducted into trim 14, heat is liberated to the external environment 22, be it an environment that is above water or submerged, which adjoins the outside surface of trim 14 by any combination or subcombination of conduction and/or mediation to external environment 22. The thermal properties of the first heat sink 47, heat pipes 90*a*-90*d* and second heatsinks 97, 98 are preferably selected in relation to the thermal properties of trim 14 and expected ambient conditions that at least about fifty percent (50%), and preferably more than about eighty percent (80%), of the heat generated by LED 37 during steady state operation is off-loaded to external environment 22 by way of the outside surface of trim 14. In the meantime, throughout the operating life of apparatus 10, at least the light emitting portion 68 of LED 37 and preferably also the driver circuit 43, remain housed safety within fluid-tight cavity 66 where they are protected against both mechanical damage and intrusion of fluids.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An LED recessed lighting apparatus, said apparatus comprising:

(a) a housing at least a portion of which is mountable in a recess having a recess opening;

(b) at least one light-emitting diode (LED) disposed within the housing;

(c) a non-vented trim having an interior side, an exterior side, and an aperture extending between said interior side and said exterior side, an inside surface of said trim facing toward said recess, said trim being affixable over at least a portion of said recess opening such that said recess is substantially isolated from direct convective thermal exchange with the environment adjoining an outside surface of said trim when said housing is mounted in said recess and said trim is affixed over said at least a portion of said recess opening;

(d) a lens having a cavity within which is located at least a light-emitting portion of said LED, said lens being mounted to allow light emitted by said LED to pass through said aperture of said trim, (e) a first heat sink of a first highly thermally conductive material, said first heat sink being intimately thermally conductively coupled to said LED and being located substantially immediately adjacent to said LED;

(f) a second heat sink of a second highly thermally conductive material, said second heat sink being mechanically supported by said trim and substantially directly thermally conductively coupled to said inside surface of said trim, and (g) a heat pipe mechanically and thermally coupled between said first heat sink and said second heat sink, said heat pipe containing a working fluid and having an evaporator portion coupled to said first heat sink and a condenser portion coupled to said second heat sink such that the heat generated by said LED during normal steady state operation can be thermally conducted to said trim by way of a thermal path which includes said first beat sink, said heat pipe and said second heat sink.

2. The LED lighting apparatus of claim 1 wherein said cavity is a fluid-tight cavity which cannot be infiltrated by fluid under normal operating conditions.

3. The LED lighting apparatus of claim 1 wherein said thermal path is of sufficiently high heat carrying capacity and is sufficiently low thermal resistance that not less than about fifty percent of said heat generated by said LED is thermally conducted to said trim during normal steady state operation.

4. The LED lighting apparatus of claim 1 wherein said LED is mounted supportably on a substrate at least a portion of which is interposed between said LED and said first heat sink such that said thermal path further includes said substrate.

5. The LED lighting apparatus of claim 4 wherein said substrate includes at least one electrically conductive path for supplying electrical energy to said LED to enable said LED to emit light.

6. The LED lighting apparatus of claim 4 wherein said substrate carries a driver for electrically driving said LED and wherein said driver is located within said cavity.

7. The LED lighting apparatus of claim 1 further comprising a peripheral seal disposed between said inside surface of said trim and said recess opening to prevent infiltration of liquid into said recess.

8. The LED lighting apparatus of claim 1 wherein said housing comprises a wet niche.

9. The LED lighting apparatus of claim 1 wherein said first highly thermally conductive material and said second highly thermally conductive material are comprised of the same material.

10. The LED lighting apparatus of claim 1 wherein said first highly thermally conductive material and said second highly thermally conductive material comprise different materials.

11. The LED lighting apparatus of claim 1 wherein said lens comprises a lens which does not significantly refract the light.

12. The LED lighting apparatus of claim 1 wherein said lens comprises lens which diffuses the light.

13. The LED lighting apparatus of claim 1 wherein said lens comprises a lens which focuses the light.

14. The LED lighting apparatus of claim 1 wherein said lens comprises a lens which changes a wavelength of the light.

15. An LED recessed lighting module, comprising:

(a) at least one light-emitting diode (LED);

(b) a lens having a cavity within which is located at least a light-emitting portion of said LED;

(c) a first heat sink of a first highly thermally conductive material, said first heat sink being mechanically connected to said lens said first heat sink being located not more than a very short distance from said LED and being intimately thermally conductively coupled to said LED and being located in said lens;

(d) a heat pipe containing a working fluid, said heat pipe having a condenser portion and an evaporator portion, said evaporator portion of said heat pipe being mechanically coupled to said first heat sink and intimately thermally conductively coupled to said first heat sink, and (e) a second heat sink of a first highly thermally conductive material, said second heat sink being adapted to be mechanically coupled to, and intimately thermally coupled to, an inside surface of a trim of a lighting fixture said second heat sink being mechanically coupled to said condenser portion of said heat pipe and intimately thermally conductively coupled to said condenser portion of said heat pipe.

16. The LED lighting module of claim 15 wherein said cavity is a fluid-tight cavity which cannot be infiltrated by fluid under normal operating conditions.

17. The LED lighting module of claim 15 wherein said first heat sink, said heat pipe and said second heat sink form a thermal path of sufficiently high heat carrying capacity and sufficiently low thermal resistance that not less than about fifty percent of the heat generated by said LED during normal steady state operation can be thermally conducted to said trim.

18. The LED lighting module of claim 17 wherein said LED is mounted supportably on a substrate at least a portion of which is interposed between said LED and said first heat sink such that said thermal path further includes said substrate.

19. The LED lighting module of claim 18 wherein said substrate includes at least one electrically conductive path for supplying electrical energy to said LED to enable said LED to emit light.

20. The LED lighting module of claim 18 wherein said substrate carries a driver for electrically driving said LED.

21. The LED lighting module of claim 15 wherein said first highly thermally conductive material and said second highly thermally conductive material are comprised of the same material.

22. The LED lighting module of claim 15 wherein said first highly thermally conductive material and said second highly thermally conductive material comprise different materials.

23. The LED lighting module of claim 15 wherein said lens comprises a lens which does not significantly refract the light.

24. The LED lighting module of claim 15 wherein said lens comprises lens which diffuses the light.

25. The LED lighting module of claim 15 wherein said lens comprises a lens which focuses the light.

26. The LED lighting module of claim 15 wherein said lens comprises a lens which changes a wavelength of the light.

* * * * *